United States Patent [19]

Savori et al.

[11] Patent Number: 4,778,145

[45] Date of Patent: Oct. 18, 1988

[54] DEVICE FOR CORRECTLY POSITIONING A STEEL CAP ON A SHOE LAST DURING MOLDING OF THE SHOE

[75] Inventors: Marco Savori; Giovanni Rossi, both of Mede, Italy

[73] Assignee: Esjot Werke Schiermeister & Junker GmbH & Co. KG., Ense-Niederense, Fed. Rep. of Germany

[21] Appl. No.: 83,774

[22] Filed: Aug. 7, 1987

[30] Foreign Application Priority Data

Aug. 7, 1986 [DE] Fed. Rep. of Germany ..... 3626710

[51] Int. Cl.[4] ..... B29C 39/26; B29C 45/26

[52] U.S. Cl. ..... 249/83; 36/77 R; 264/275; 425/119; 425/129.2

[58] Field of Search ..... 249/83, 85; 264/244, 264/275; 425/110, 119, 129.2; 36/77 R

[56] References Cited

U.S. PATENT DOCUMENTS 3,577,503 5/1971 Innocenti ..... 425/119

4,453,904 6/1984 Koliwer ..... 425/129 S

*Primary Examiner*—Willard Hoag

*Attorney, Agent, or Firm*—Herbert Dubno; Ronald Lianides

[57] ABSTRACT

A steel cap is mounted on a shoe molding last during molding, particularly during the initial molding of a plastic shoe. The steel cap furthermore is supported on the shoe molding last by a plurality of projecting members distributed over the surface of the steel cap extending from it or the shoe molding last. At least one releasable holding or retaining means is provided on the shoe molding last which holds the steel cap on the shoe molding last secure against unintended release. To obtain a nearly flawless jacket or sheath of synthetic resin about the steel cap the holding or retaining means comprises at least one slender elastic pin directed transverse to the insertion direction of the steel cap. The steel cap has at least one of the elastic pins engaging against a roughened interior surface of the steel cap and the pin locks in the roughened surface of the steel cap under compression.

12 Claims, 1 Drawing Sheet

DEVICE FOR CORRECTLY POSITIONING A STEEL CAP ON A SHOE LAST DURING MOLDING OF THE SHOE

FIELD OF THE INVENTION

Our present invention relates to a device for the positionally correct mounting or orientation of a steel cap for a shoe tip on a shoe molding bar or last, during molding of a shoe, especially during the initial molding of a shoe or the like made of a plastic synthetic resin.

BACKGROUND OF THE INVENTION

A device for correctly mounting or positioning a steel cap on a shoe molding last during molding, particularly during the initial molding of a plastic shoe or the like, is known.

The steel cap is mounted on the shoe molding last by being supported thereon by projections distributed over the surface of the steel cap and extending from the shoe molding last or the steel cap. At least one releasable holding or retaining means is provided on the shoe molding last which holds the steel cap on the shoe molding last secure against unintended release.

In an earlier device for mounting the steel cap on the shoe molding last which permits the initial molding of the shoe to proceed with the plastic material the steel caps are surrounded both on the outside and also on the inside with plastic material and thus correctly positioned on the shoe and permanently imbedded in it. Magnets effective as retaining or holding means are used for holding the steel cap on the shoe molding last. These magnets exert such a great holding force during the molding of the shoe that the steel cap is held with accuracy in position relative to the shoe molding last. However it is possible to remove the molding last from the shoe.

Disadvantageously a large contacting or bearing surface is required for the magnets to be able to exert a sufficient holding force on the steel cap. This leads necessarily to comparatively large surface contacts and hence large cavities for the magnets in the synthetic resin sheath surrounding the steel cap in whose vicinity the steel cap is uncovered. Consequently the fit of the shoe is poorer.

OBJECTS OF THE INVENTION

It is an object of our invention to provide an improved device for mounting a steel cap on a shoe molding last during molding of the shoe which will obviate these drawbacks.

It is another object of our invention to provide an improved device for mounting a steel cap on a shoe molding last during molding of the shoe in which a nearly flawless encasement of the steel cap in the shoe is attainable.

SUMMARY OF THE INVENTION

These objects and others which will become more readily apparent hereinafter are attained in accordance with our invention in a device for mounting and correctly positioning a steel cap on a shoe molding last during molding, particularly during the initial injection molding of a synthetic resin shoe or the like.

The cap is supported on the shoe molding last by projecting members distributed over the surface of the steel cap and extending from the shoe molding last or from the steel cap. At least one releasable retention or retaining means is provided on the shoe molding last which holds the steel cap on the shoe molding last secure against unintended release.

According to our invention the retention or retaining means comprises at least one slender elastic pin extending transverse to the insertion direction of the steel cap. The steel cap has the pin engaging against a roughened interior surface of the steel cap and the pin locks on the roughened surface of the steel cap under compression.

The slender compressible pin in the steel cap jacket is reduced in width compared to the width of the cavity generated in the sheath by the magnet which is omitted in accordance with the invention.

Thus because of the engagement of the pin on the steel cap a secure retention of the steel cap during molding of the shoe is guaranteed. Moreover a comparatively small compression force is necessary which guarantees a damage free removal of the shoe molding last.

It is particularly advantageous when the pin ends in a slender, especially conical, tip. Thus the elastic pin makes a smaller cavity than has been used before. The locking engagement or clawing of the pin on the roughened surface of the steel cap is improved while on the other hand the sides of the pin tip form slanted guide ramps during removal of the shoe which facilitates the release of the pin from the roughened steel cap surface.

It has been formed to be advantageous to form the roughened surface of the steel cap has grooves with slanted sides running transverse to the insertion direction of the steel cap. Also advantageously the pin or pins are positioned near the steel cap to engage in these grooves. The compressible pin advantageously can extend from the surface of the shoe molding last.

In another embodiment of our invention to relieve the compressible or spring loaded pins from the force of gravity of the steel cap, advantageously the compressible pin extends from the shoe molding last in the direction of the force of gravity.

The compressible pin can also be made so that it is held compressible in its longitudinal direction in the shoe molding last.

In yet another particularly simple form of our invention the compressible pin can advantageously comprise a coil spring.

To satisfy the objects of our invention the projecting members of the shoe molding last abutting on the steel cap preferably end in narrow, particularly conical, peaks.

Moreover it is also advantageous for the projecting members abutting on the steel cap and if necessary the spring loaded pins of the shoe molding last to be held on the shoe molding last so as to be adjustable in the direction of their longitudinal extent so that the thickness of the steel cap jacket can be varied.

BRIEF DESCRIPTION OF THE DRAWING

The above and other objects, features and advantages of our invention will become more readily apparent from the following description, reference being made to the accompanying highly diagrammatic drawing in which.

SPECIFIC DESCRIPTION

The removable shoe molding last 3 acting as a mold core is inserted in the mold cavity 1 of a mold 2 used to make synthetic resin safety shoes or the like by initial molding so that it is positioned with clearance from the wall of the mold cavity 1.

Figure 1:
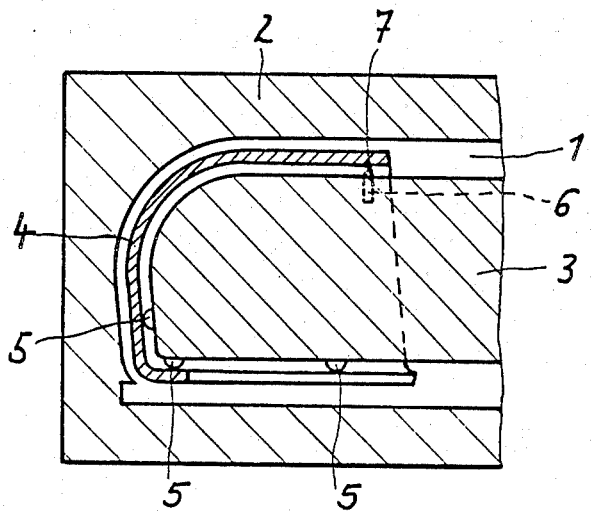
FIG. 1 is a partial longitudinal cross sectional view broken away of a mold for initial molding of a synthetic resin shoe.
Figure 2:
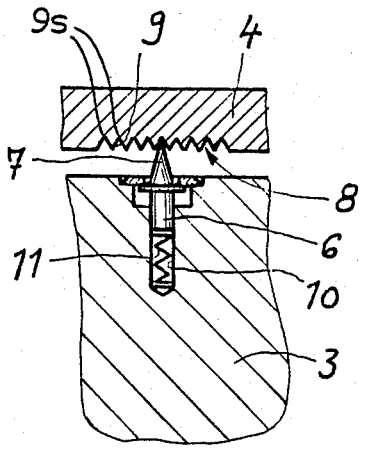
FIG. 2 is an enlarged detail view of a portion of the cross sectional view of FIG. 1.

A steel cap 4 is mounted on the tip of the shoe molding last 3. So that the shoe molding last 3 is enveloped inside of the synthetic resin material introduced into the mold, a plurality of rigid projecting members 5 distributed around the inner surface of the steel cap 4 extend from the shoe molding last 3 and hold the steel cap 4 spaced from the shoe molding last 3 in the embodiment of FIG. 1.

So that the steel cap 4 can not unintentionally slide from the shoe molding last 3, a retaining or retention means in the form of a compressible or elastically depressible pin 6 is provided on the shoe molding last 3. It has an outer end forming a conical point 7 which is directed substantially perpendicularly to the opposite region 8 of the steel cap 4.

Moreover, the surface of the above named region 8 of the steel cap 4 is roughened forming a plurality of grooves 9 with inclined sides 9*s* running transversely to the insertion direction of the steel cap 4. The tip 7 of the elastically depressible pin 6 engages in these grooves 9. The spring-biased pin 6 is mounted so as to be axially slidable to a limited extent in a hole 10 of the shoe molding last 3 and is in this case biased by spring 11 which presses the pin 6 continuously outwards. The compressive force of the coil spring 11 is so designed that the steel cap 4, once mounted on the shoe molding last 3, is held in its correct position and secured in place during the initial molding of the shoe.

However, the pin 6 can be forced back against the force of the coil spring 11 so that the molding last 3 can be removed from the shoe without danger of damage to the synthetic resin sheath or layer surrounding the steel cap 4.

Figure 3:
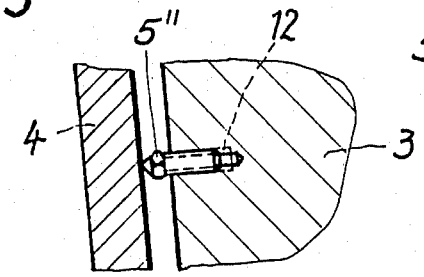
FIG. 3 is another enlarged detail view of a portion of the cross sectional view of another embodiment of our invention.

According to the embodiment of FIG. 3 the projecting member 5″ is axially adjustable in the shoe molding last 3. This projecting member 5″ is an adjusting screw and is screwed into a threaded hole of the shoe molding last 3 in which it fits. Moreover this projecting member 5″ has a conical point or tip at its free end.

Figure 4:
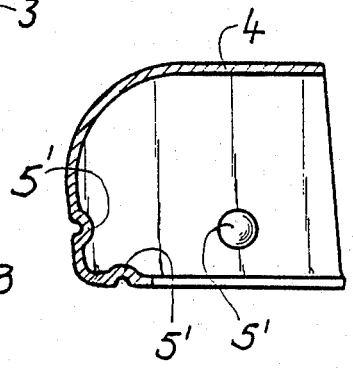
FIG. 4 is a partial longitudinal cross sectional view of a somewhat different steel cap according to our invention.

In the embodiment of FIG. 4 for spacing the steel cap 4 from the shoe molding last 3 slender projecting members 5′ are located on the steel cap 4 and project inwardly to the shoe molding last 3 and are braced on it. They can be formed on the steel cap 4 as is indicated in FIG. 4.

All new features and combinations of features disclosed in this description and/or drawing are to be considered part of the invention.

We claim:

1. In a device for correctly positioning a steel cap on a shoe molding last during molding, particularly during the initial molding of a synthetic resin shoe, said steel cap being supported on said shoe molding last by a plurality of projecting members distributed over the surface of said steel cap extending therefrom or from said shoe molding last and at least one releasable retention and retaining means is provided on said shoe molding last which holds said steel cap on said shoe molding last secure against unintended release, the improvement wherein said retention and retaining means comprises at least one elastic pin directed transverse to an insertion direction of movement of said steel cap onto a toe portion of said last, said pin being engageable with a roughened interior surface of said steel cap to lock said pin with said roughened surface of said steel cap under compression.

2. The improvement according to claim 1 wherein said elastic pin ends in a conical tip.

3. The improvement according to claim 1 wherein said pin is engageable with at least one groove of said roughened surface of said steel cap having a plurality of grooves with inclined sides running transverse to said insertion direction of said steel cap.

4. The improvement according to claim 3 wherein said elastic pin is positioned to engage in said grooves.

5. The improvement according to claim 1 wherein said elastic pin extends away from said surface of said shoe molding last.

6. The improvement according to claim 1 wherein said elastic pin extends away from said shoe molding last in an upward direction.

7. The improvement according to claim 1 wherein said elastic pin is mounted in said shoe molding last so as to be elastically depressible axially.

8. The improvement according to claim 1 wherein said elastic pin is biased by a coil spring.

9. The improvement according to claim 1 wherein said projecting members supporting said steel cap are provided on said shoe molding last and each ends in a projecting member peak.

10. The improvement according to claim 9 wherein each projecting-member peak is conical.

11. The improvement according to claim 9 wherein said projecting members are adjustable in respective longitudinal directions thereof.

12. A device for correctly positioning a steel cap on a shoe molding last during an initial molding of a synthetic resin shoe or the like, comprising:

a plurality of projecting members distributed over the surface of said steel cap extending from said shoe molding last for mounting said steel cap on said shoe molding last; and at least one releasable retention or retaining means comprising at least one conically tipped elastically biased pin extendable from said shoe molding last transverse to an insertion direction of said steel cap over said last, said pin being provided in a toe portion off said shoe molding last and releasably holding said steel cap on said shoe molding last, said pin engageable with a plurality of grooves with inclined sides running transverse to said insertion direction of said steel cap in a roughened interior surface of said steel cap and said pin locking in said grooves of said roughened surface under compression.

* * * * *